US009337538B2

(12) United States Patent
Ning

(10) Patent No.: US 9,337,538 B2
(45) Date of Patent: May 10, 2016

(54) ANTENNA

(75) Inventor: Shuman Ning, Shenzhen (CN)

(73) Assignee: ZTE CORPORATION, Shenzhen, Guangdong (CN)

( * ) Notice: Subject to any disclaimer, the term of this patent is extended or adjusted under 35 U.S.C. 154(b) by 136 days.

(21) Appl. No.: 14/130,444

(22) PCT Filed: Oct. 18, 2011

(86) PCT No.: PCT/CN2011/080935

§ 371 (c)(1),
(2), (4) Date: Dec. 31, 2013

(87) PCT Pub. No.: WO2013/004060

PCT Pub. Date: Jan. 10, 2013

(65) Prior Publication Data

US 2014/0118208 A1 May 1, 2014

(30) Foreign Application Priority Data

Jul. 1, 2011 (CN) ..... 2011 1 0183502

(51) Int. Cl.
*H01Q 5/00* (2015.01)
*H01Q 9/42* (2006.01)
(Continued)

(52) U.S. Cl.
CPC ..... *H01Q 5/0093* (2013.01); *H01Q 1/2291* (2013.01); *H01Q 1/38* (2013.01); *H01Q 1/48* (2013.01); *H01Q 5/378* (2015.01); *H01Q 9/40* (2013.01); *H01Q 9/42* (2013.01); *H01Q 13/10* (2013.01)

(58) Field of Classification Search
CPC ..... H01Q 1/2291; H01Q 1/38; H01Q 1/48; H01Q 5/378; H01Q 5/50; H01Q 13/10
USPC ..... 343/767, 846, 848
See application file for complete search history.

(56) References Cited

U.S. PATENT DOCUMENTS 6,140,975 A 10/2000 Cohen
7,212,161 B2 5/2007 Chen et al
(Continued)

FOREIGN PATENT DOCUMENTS

CN 2653718 Y 11/2004
CN 101291014 A 10/2008
JP 2003309416 A 10/2003

OTHER PUBLICATIONS

International Search Report (Form PCT/ISA/210) for PCT/CN2011/080935 dated Mar. 15, 2012.
(Continued)

*Primary Examiner* — Hoang V Nguyen
(74) *Attorney, Agent, or Firm* — Koppel, Patrick, Heybl & Philpott

(57) ABSTRACT

The disclosure provides an antenna, which comprises: a radiating unit, an antenna ground and a slot, wherein the radiating element is configured to be a curved metal wire to receive or radiate electromagnetic wave signals; the projection area of the radiating element serves as the antenna ground; and the antenna ground is provided with the slot which is configured to couple and resonate with the radiating element. The disclosure solves the problem that the antenna in relevant art can not meet the requirements of dual frequencies simultaneously, and thus achieves the effect of meeting the requirements of dual frequencies simultaneously.

18 Claims, 5 Drawing Sheets

(51) Int. Cl.

| | |
|---|---|
| ***H01Q 1/22*** | (2006.01) |
| ***H01Q 1/38*** | (2006.01) |
| ***H01Q 1/48*** | (2006.01) |
| ***H01Q 9/40*** | (2006.01) |
| ***H01Q 13/10*** | (2006.01) |
| ***H01Q 5/378*** | (2015.01) |

(56) References Cited

U.S. PATENT DOCUMENTS

| | | | | |
|---|---|---|---|---|
| 7,486,242 | B2 * | 2/2009 | Gala Gala | H01Q 1/243 343/702 |
| 7,551,142 | B1 * | 6/2009 | Zhang | H01Q 1/243 343/700 MS |
| 2002/0008664 | A1 | 1/2002 | Bark et al. | |
| 2002/0024466 | A1 | 2/2002 | Masuda | |
| 2004/0017318 | A1 | 1/2004 | Annabi et al. | |

OTHER PUBLICATIONS

English Translation of the Written Opinion of the International Searching Authority (PCT/ISA/237) dated Apr. 5, 2012 for PCT/CN2011/080935.

Written Opinion of the International Searching Authority (PCT/ISA/237) dated Apr. 5, 2012 for PCT/CN2011/080935.

Arnau Cabedo, et al., "Multiband Handset Antenna Combining a PIFA. Slots, and Ground Plane Modes", IEEE Transactions on Antennas and Propagation, vol. 57, No. 9, Sep. 2009.

Extended European Search Report from European Patent Appl. No. 11868959.5, Feb. 18, 2015.

* cited by examiner

Fig. 4
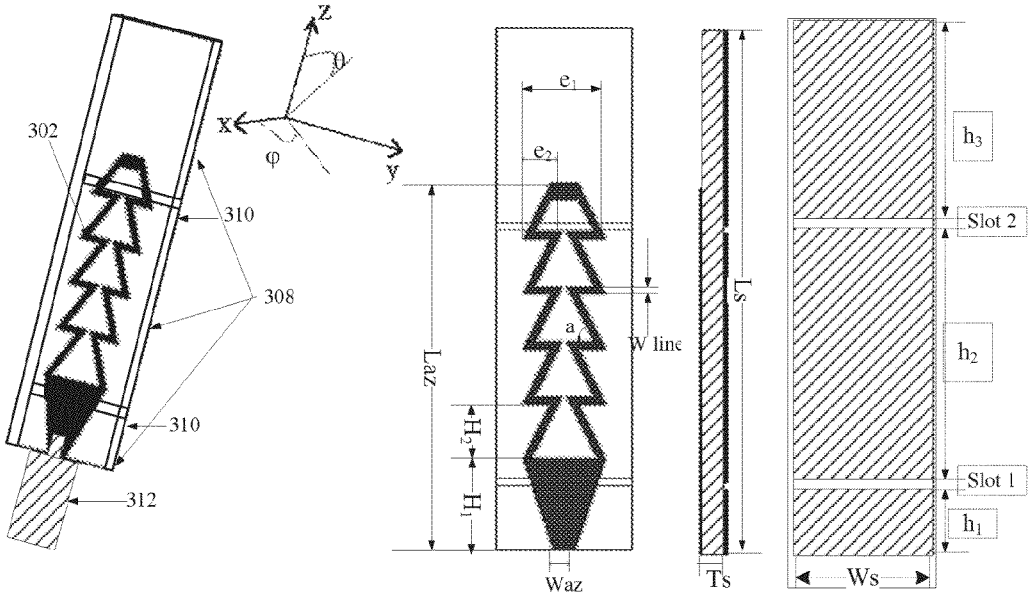
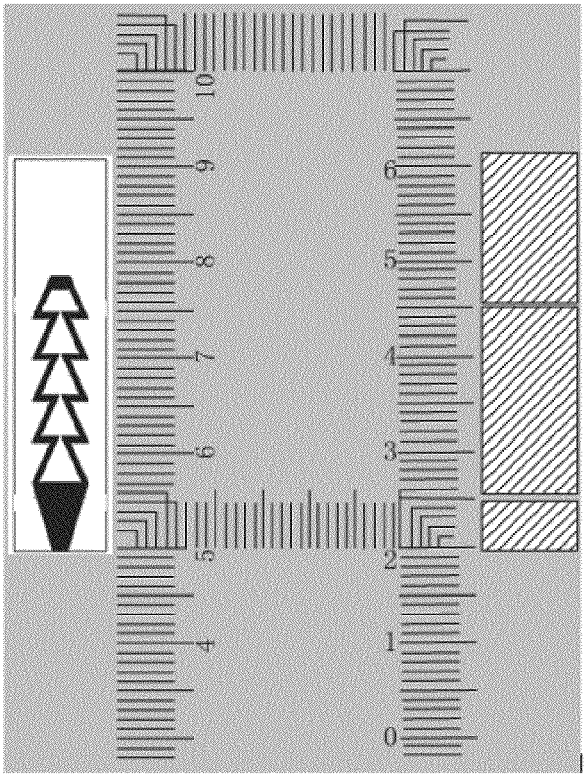
Fig. 5

ANTENNA

TECHNICAL FIELD

The disclosure relates to the communication field, and in particular to an antenna.

BACKGROUND

With the development of wireless technology, Wireless Local Area Network (WLAN) technology gains the favour of more and more consumers and is valued in more and more products. At present, hot Customer Premise Equipment (CPE) products, Mobile Internet Devices (MID) products and Pad products are required to effectively connect to the Internet through WLAN anywhere and anytime.

In the above terminal products, antenna, as an important part for implementing the function of connecting to the Internet through WLAN anywhere and anytime, directly impacts the transceiving performance of the terminal products, including Internet speed and stability. At present, relevant technology mostly supports 2.4 GHz single-frequency antenna only. The antenna is provided with a single frequency point only, and the antenna generally adopts a conventional bracket form.

In this way, a problem is caused, that is, the antenna in relevant art can not meet the requirements of dual frequencies simultaneously, for example, the antenna can not meet the dual-frequency requirement of 802.11/a/b/g. Further, another problem is caused, that is, the antenna in relevant art can not realize lower cost, smaller antenna area and lower antenna height in the design of structure.

SUMMARY

In view of the above problem that the antenna in relevant art can not meet the requirements of dual frequencies simultaneously, the disclosure provides an antenna.

According to one aspect of the disclosure, an antenna is provided, including: a radiating unit, an antenna ground and a slot, wherein the radiating unit is configured to be a curved metal wire to receive or radiate electromagnetic wave signals; the antenna ground is provided at a projection area of the radiating unit; the slot is provided on the antenna ground and configured to couple and resonate with the radiating unit.

Preferably, the antenna further includes: a feeder provided between the radiating unit and a feeding point of the antenna, wherein the feeder is an impedance control line with increasing impedance, and configured to increase a working bandwidth of the antenna and to match the impedance of the radiating unit and the impedance of the feeding point.

Preferably, the rear end of the feeding point is provided with a matching network, which is configured to adjust a resonance point of the radiating unit.

Preferably, the feeding point is connected with a terminal through the impedance control line.

Preferably, the impedance control line is one or some combination of the following: a straight line, an S shaped line, and a curved line; and the routing of the impedance control line is a microstrip line or a strip line.

Preferably, the curved metal wire is a symmetrical triangular or rectangular curved metal wire.

Preferably, the slot is hollowed out, or is filled with non-metal mediums.

Preferably, the antenna is provided on a Printer Circuit Board (PCB) to form a PCB antenna; and the PCB antenna is routed on a single-layer board or multi-layer board.

Preferably, the PCB antenna is provided on the same side of the terminal as the Wireless Fidelity (WIFI) or Bluetooth (BT), or provided on the top of the terminal.

Preferably, the antenna is applied to a WLAN.

Therefore, by designing the radiating unit as a curved metal wire and opening a slot on the antenna ground for coupling resonance with the radiating unit, the disclosure adjusts the resonant frequency of the antenna, increases the working bandwidth of the antenna, solves the problem that the antenna in relevant art can not meet the requirements of dual frequencies simultaneously, for example, the antenna can not meet the dual-frequency requirement of 802.11/a/b/g/n 2.4 GHz and 5 GHz, and thus achieves the effect of meeting the requirements of dual frequencies simultaneously.

BRIEF DESCRIPTION OF THE DRAWINGS

Drawings, provided for further understanding of the disclosure and forming a part of the specification, are used to explain the disclosure together with embodiments of the disclosure rather than to limit the disclosure, wherein:

FIG. 4 shows a simulation structure of the antenna shown in FIG. 1;

FIG. 5 shows a physical image of the antenna shown in FIG. 1; and

DETAILED DESCRIPTION OF THE EMBODIMENTS

Figure 1:
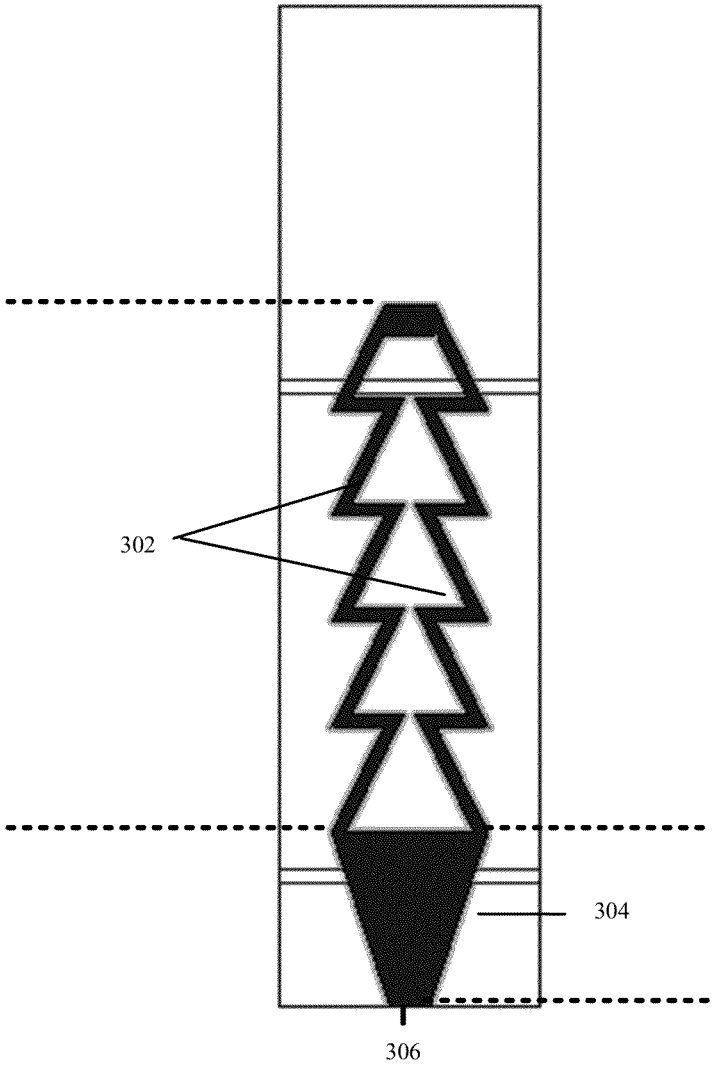
FIG. 1 shows a frontside structure of an antenna according to the third embodiment of the disclosure.

The preferred embodiments are described in conjunction with the drawings as follows. It shall be understood that the embodiments of the present application and the features of the embodiments can be combined with each other if there is no conflict.

Embodiment 1

An antenna in this embodiment includes: a radiating unit, an antenna ground and a slot, wherein the radiating unit is designed as a curved metal wire (for example, symmetrical triangular or rectangular curved metal wire) to receive or radiate electromagnetic wave signals; the antenna ground is provided at a projection area of the radiating element; and the antenna ground is provided with a slot which is configured to couple and resonate with the radiating unit. This antenna might be an antenna applied to WLAN technology.

By opening the slot, which is configured to couple and resonate with the radiating unit, on the surface of the antenna ground, the disclosure adjusts the resonant frequency of the antenna, increases the working bandwidth of the antenna, enables the antenna to meet the requirements of dual frequencies simultaneously, solves the problem that the antenna in relevant art can not meet the requirements of dual frequencies simultaneously, and thus achieves the effect of meeting the requirements of dual frequencies simultaneously.

Preferably, the antenna according to this embodiment further includes: a feeder, which is provided between the radiating unit and a feeding point of the antenna. The feeder in this embodiment is an impedance control line with increasing impedance, which is configured to increase the working bandwidth of the antenna and to match the impedance of the radiating unit and the feeding point. Through the feeder with increasing impedance, the working bandwidth of the antenna can be optimized effectively.

Preferably, the curved metal wire of the radiating unit is a symmetrical triangular or rectangular curved metal wire. The symmetrical triangular or rectangular curved metal wire can better implement the receiving and radiating of electromagnetic wave signals.

Preferably, the slot is hollowed out, or is filled with non-metal mediums. This processing mode is simple to implement and saves the cost of the antenna, on the basis of welling implementing coupling resonance.

Preferably, the rear end of the feeding point is provided with a matching network, which is provided to adjust the resonance point of the radiating unit.

Preferably, the feeding point is connected with a terminal through the impedance control line.

Preferably, the impedance control line is one or some combination of the following: a straight line, an S shaped line, and a curved line; and the routing of the impedance control line is a microstrip line or a strip line.

Preferably, the antenna is provided on a PCB to form a PCB antenna; and the PCB antenna is routed on a single-layer board or multi-layer board. Preferably, the PCB antenna is routed on the single-layer board. Routing on the single-layer board is easy to implement and can avoid problems such as leakage probably existing in multi-layer board wiring.

Preferably, the PCB antenna is provided on the same side of the terminal as the Wireless Fidelity (WIFI) or Bluetooth (BT) radio frequency output, or provided on the top of the terminal, to better radiate or receive electromagnetic wave signals.

Preferably, the antenna in this embodiment is applied to a WLAN.

Embodiment 2

This embodiment provides a dual-frequency PCB curved antenna with a slot, which can meet the requirements of PCB layout and structure, is easy to adjust and can reduce the cost of the antenna.

The antenna in this embodiment includes five parts.

(1) A feeding point of the antenna, which is provided at the connection position of the antenna and the radio frequency signal of the terminal mainboard, and can be implemented by reference to the feeding point of the antenna in relevant art.

(2) A feeder of the antenna, which is an antenna feeder with increasing impedance in this embodiment, and is configured to connect the radiating unit of the antenna with the feeding point to match impedance and adjust the working bandwidth of the antenna.

(3) A curved-metal-line radiating unit provided at the front side of the antenna, which is configured to receive and radiate electromagnetic wave signals.

(4) A slot opened on the backside of the antenna, which mainly enables coupling resonance.

(5) A metal ground of the antenna, that is, antenna ground, which is the reference ground of the antenna.

In order to implement the antenna in this embodiment, a blank area can be reserved on the PCB of the terminal product to lay out the PCB antenna. The PCB antenna can be routed on a single-layer board or a multi-layer board, and radiates electromagnetic wave signals adopting a slot coupling mode. The feeding point of the antenna is connected with the input/output pin of a radio frequency switch antenna on the PCB board, through the impedance control feeder and the antenna matching network. The curved metal line on the front side serves as the radiating unit of the antenna, and the projection area of the radiating unit serves as the reference ground of the antenna, that is, antenna ground; a gap is opened on the antenna ground, that is, a slot, so as to perform coupling resonance, wherein the gap can be filled with non-metal mediums, or can be hollowed out.

Preferably, the position of the PCB antenna can be set on the same side as the WIFI/BT radio frequency output; with a Pad product as an example, the PCB antenna can be set on the same side of the Pad product as the WIFI/BT radio frequency output, also can be set on the top of the terminal product. The setting of the PCB antenna includes but not limited to the above two conditions; those skilled in the art can adjust the position according to actual needs, only needing to avoid the holding area.

Preferably, the curved metal wire on the front side of the antenna is a symmetrical curved metal wire. The shape of the curved metal wire can be adjusted as, for example, triangle or rectangle, according to the simulation result of actual layout. In addition, those skilled in the art can adjust the curved metal wire as other shapes during actual use; the disclosure does not limit this.

Preferably, the antenna feeder adopts an improved impedance control line with increasing impedance, which can increase the working bandwidth of the antenna.

Preferably, the projection area below the curved-metal-line radiating unit disposed on the front side of the antenna serves as the reference ground of the antenna, that is, antenna ground; a gap (that is, slot) is opened on the antenna ground, wherein the gap can be hollowed out, or can be filled with non-metal mediums.

Preferably, the gap opened on the antenna ground can be adjusted in position, number, length and width, so as to adapt to the actual layouts of different products and to adjust the resonant frequency and working bandwidth of the antenna.

Preferably, the antenna feeding point is connected with the mainboard of the terminal product through the impedance control line, wherein the impedance control line might be one or some combination of the following: a straight line, an S shaped line, and a curved line; the routing of the impedance control line might be a microstrip line or a strip line.

Preferably, the rear end of the antenna feeding point is provided with a matching network, which is configured to adjust the resonance point and includes serial and parallel compactor inductors.

Preferably, the radiating unit of the antenna preferably selects single-layer board routing, also can select dual-layer or multi-layer board routing; the specific setting mode can be adjusted according to actual needs. In the condition of multi-layer board routing, the curved-metal-line radiating units can be interconnected through buried hole, through hole, via hole and the like; the size of the curved-metal-line radiating unit can be adjusted flexibly according to actual debug. Compared with multi-layer board routing, the single-layer board routing is easy to implement and can avoid problems such as leakage.

With the antenna provided by this embodiment, not only the dual-frequency requirements of WLAN 2.4-2.48 GHz (802.11b/g) and 5 GHz (802.11a) can be met simultaneously, but the requirements of low cost, small size, super-thin appearance in the structure design can be met too.

Embodiment 3

Figure 2:
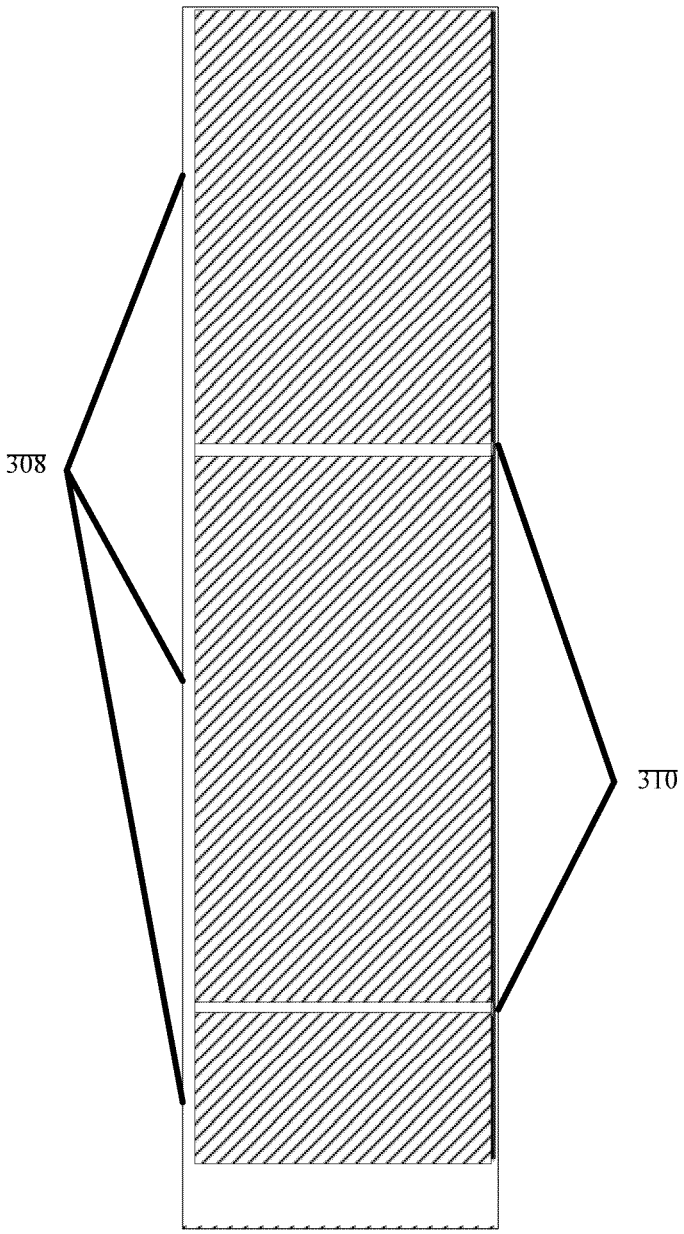
FIG. 2 shows a backside structure of the antenna shown in FIG. 1.
Figure 3:
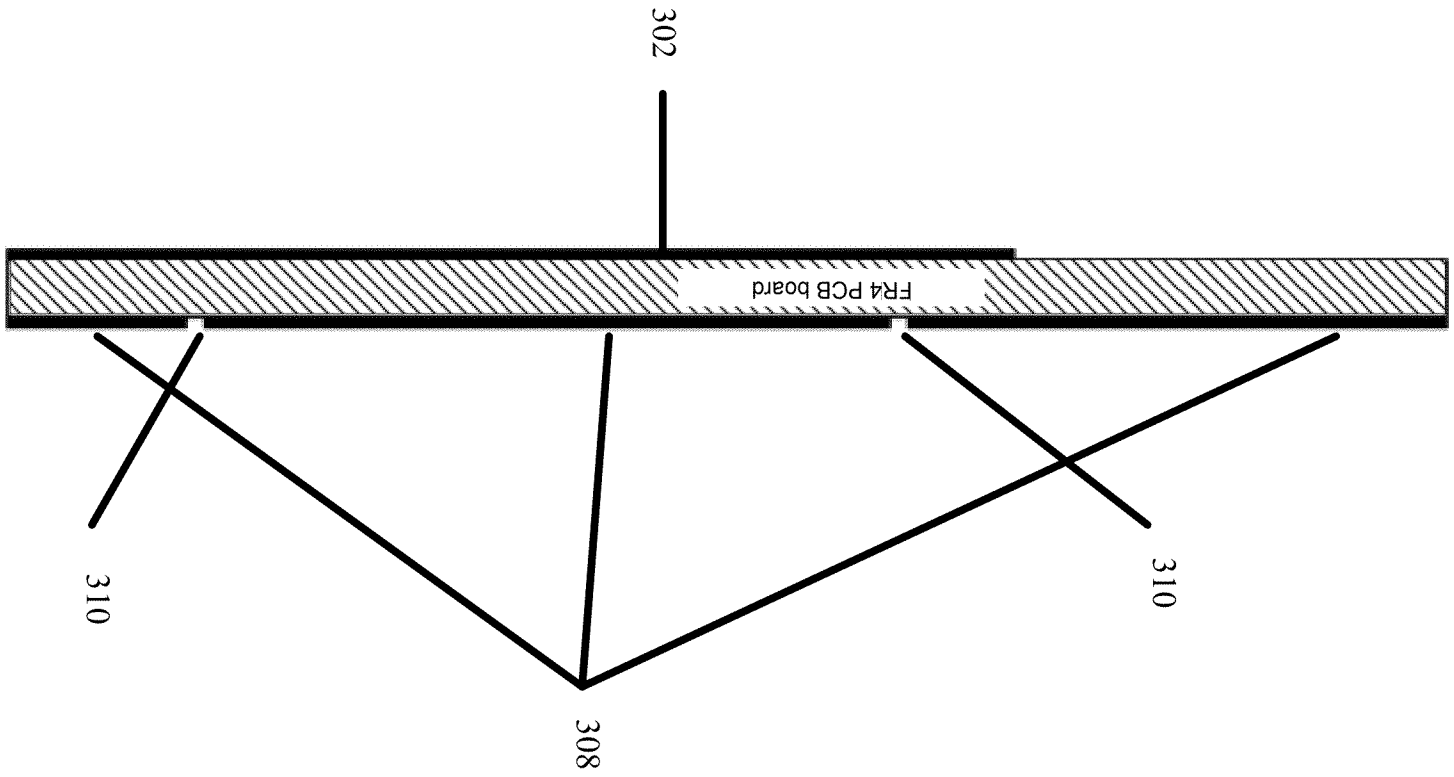
FIG. 3 shows a lateral structure of the antenna shown in FIG. 1.

This embodiment provides a dual-frequency PCB curved antenna with a slot. The frontside, backside and lateral structure diagrams of the antenna are shown respectively in FIG. 1, FIG. 2 and FIG. 3 respectively. FIG. 1 shows a frontside structure of the antenna according to the third embodiment of the disclosure; FIG. 2 shows a backside structure of the antenna shown in FIG. 1; FIG. 3 shows a lateral structure of the antenna shown in FIG. 1.

The PCB antenna in this embodiment includes a curved-metal-line radiating unit 302, an optimized impedance-increasing feeder 304, an antenna feeding point 306, an antenna ground 308 and a slot 310.

FIG. 4 shows a simulation structure of the antenna shown in FIG. 1, as shown in FIG. 4, the antenna size simulation data of the curved metal line of the curved-metal-line radiating unit 302 can refer to Table 1. The antenna feeding point 306 is connected to a Small A type connector (SMA connector, with full name of SMA reversed polarity male) 312. The antenna ground 308 is provided with a slot 310, which can be a hollowed gap.

TABLE 1

| Curved-line antenna size | | | | | | | | | | | | |
|---|---|---|---|---|---|---|---|---|---|---|---|---|
| Parameter | Laz | $H_1$ | $H_2$ | Waz | $e_1$ | $e_2$ | Wline | Ts | Ls | Ws | a | $H_1$, $h_2$, $h_3$ |
| Value (mm) | 28 | 7 | 4.2 | 1.5 | 6 | 2.79 | 0.5 | 1.5 | 40 | 10 | 65° | variable |

The curved-metal-line radiating unit 302 is mainly configured to radiate and receive electromagnetic wave signals. Both the length and the angle of the curved-metal-line radiating unit 302 can be properly adjusted, by those skilled in the art, to determine the resonance range of the antenna, according to the actual layout of different terminal products and the selection of PCB board in conjunction with simulation result.

For the optimized impedance-increasing feeder 304, the impedance increasing condition can be properly set, by those skilled in the art, to realize impedance matching and to ensure that the equivalent impedance at the antenna feeding point 306 is 50 ohm, in conjunction with the specific layout, the selection of PCB board and the simulating calculation result. In addition, the optimized impedance-increasing feeder 304 is further configured to adjust the antenna to increase the working bandwidth of the antenna.

The rear end of the antenna feeding point 306 might be provided with a matching network, and the antenna feeding point 306 is connected with the PCB mainboard of the terminal through an impedance control line or a co-axial cable. The line width of the impedance control line is determined according to the actual use of the mainboard.

The antenna ground 308 is provided with a slot 310, which can be hollowed out, or can be filled with non-metal mediums. The slot 310 impacts the specific resonance point and the dual-frequency performance of the antenna. The number, length and width of the slot 310 can be calculated by those skilled in the art in conjunction with simulation. Generally, the antenna ground 308 is wider than the curved-metal-line radiating unit 302, and there is a difference in length between the antenna ground 308 and the curved-metal-line radiating unit 302, for example, the antenna ground 308 is longer than or shorter than the curved-metal-line radiating unit 302; of course, they two can be basically equal in length. The specific setting is performed by those skilled in the art according to the resonance frequency point and/or simulation result.

In addition, the PCB board of the antenna in this embodiment adopts a common FR4 PCB board. The PCB board also can adopt a multi-layer PCB board according to actual needs, just ensuring each layer other than the top layer and the bottom layer to be purified.

Figure 6:
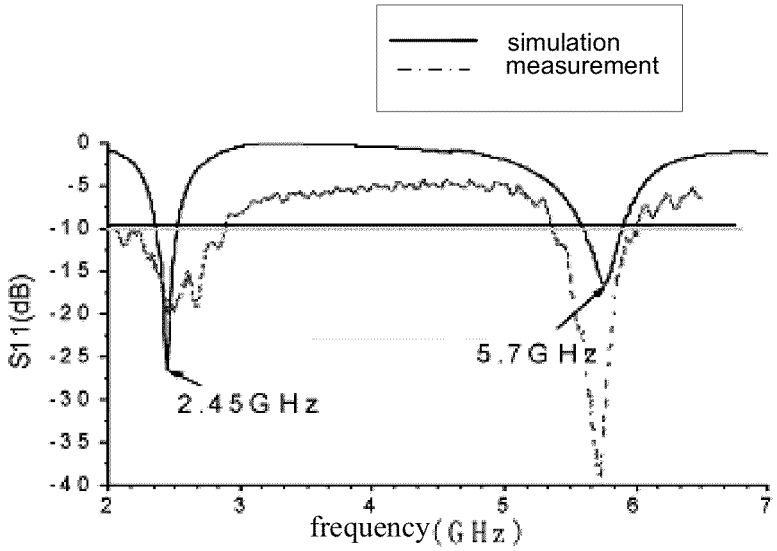
FIG. 6 shows a curved graph of the simulation of the antenna shown in FIG. 1 and the return loss debugged on a CPE product.

The simulation, the entity and the effect of the antenna in this embodiment are shown in FIG. 4, FIG. 5 and FIG. 6 respectively. FIG. 4 shows a simulation structure of the antenna in this embodiment; FIG. 5 shows a physical image of the antenna in this embodiment; FIG. 6 shows a curved graph of the simulation of the antenna in this embodiment and the return loss debugged on a CPE product.

FIG. 6 shows a curved graph of the simulation of the antenna shown in FIG. 1 and the return loss debugged on a CPE product. In FIG. 6, the real line represents a simulated return loss curve line, while the dashed line represents a measured return loss curve line.

At present, many terminal products, such as CPE, MID and Pad, mainly require the band of 2.4-2.5 GHz in WLAN and newly put forward a requirement on 5G band. From FIG. 6, it can be seen that the bandwidth of the antenna in this embodiment can completely meet the requirement of the dual-frequency WLAN antenna, with good resonance at 2.4 GHz and 5 GHz.

The antenna in this embodiment adopts a PCB form; optionally, the antenna also can adopt a Flexible Printed Circuit (FPC) form. The antenna is directly etched on a PCB board, or is connected with a mainboard through welding, coaxial cable and the like; compared with other terminal antennas, expenses for separately manufacturing antenna and antenna bracket and opening mould are saved, thus expenditure and cost are reduced; besides, the antenna size is easy to adjust, with a small height, and can meet the growing ultra-thin requirement to the greatest extent.

It should be noted that the terminal product referred in the plurality of embodiments of the disclosure includes but not limited to CPE, MID and Pad, and also can include mobile phone, data card and other products that can adopt the antenna technology. Meanwhile, the antenna band also can be adjusted through the adjustment of the electrical size of the antenna, to adapt to the requirements of various antenna bands.

In addition, the plurality of embodiments of the disclosure is illustrated by taking the PCB antenna for example; but it is not restricted to this, those skilled in the art can apply the antenna of the disclosure to other proper carriers according to actual needs; the disclosure does not limit this.

From the description above, it can be seen that, by opening a slot on the surface of the antenna ground for coupling resonance with the radiating unit, the disclosure adjusts the resonant frequency of the antenna, increases the working bandwidth of the antenna, enables the antenna to meet the requirements of dual frequencies simultaneously, solves the problem that the antenna in relevant art can not meet the requirements of dual frequencies simultaneously, and thus achieves the effect of meeting the requirements of dual frequencies simultaneously. Meanwhile, by etching the antenna on a PCB board directly or connecting the antenna with a mainboard through welding, coaxial cable and the like, the disclosure saves the expenses for separately manufacturing antenna and antenna bracket and opening mould, compared with other terminal antennas, and thus reduces expenditure and cost; besides, the antenna size is easy to adjust, with a small height, and can meet the growing ultra-thin requirement to the greatest extent.

Obviously, those skilled in the art shall understand that the above-mentioned modules and steps of the disclosure can be realized by using general purpose calculating device, can be integrated in one calculating device or distributed on a network which consists of a plurality of calculating devices. Alternatively, the modules and the steps of the disclosure can be realized by using the executable program code of the calculating device. Consequently, they can be stored in the storing device and executed by the calculating device, or they are made into integrated circuit module respectively, or a plurality of modules or steps thereof are made into one integrated circuit module. In this way, the disclosure is not restricted to any particular hardware and software combination.

The descriptions above are only the preferable embodiment of the disclosure, which are not used to restrict the disclosure. For those skilled in the art, the disclosure may have various changes and variations. Any amendments, equivalent substitutions, improvements, etc. within the disclosure are all included in the scope of the protection of the disclosure.

What is claimed is:

1. An antenna, comprising: a radiating unit, an antenna ground and a slot, wherein the radiating unit is configured to be a curved metal wire to receive or radiate electromagnetic wave signals;

the antenna ground is provided at a projection area of the radiating unit; and the slot is provided on the antenna ground and configured to couple and resonate with the radiating unit;

wherein the curved metal wire is a symmetrical triangular or rectangular curved metal wire.

2. The antenna according to claim 1, further comprising:

a feeder, provided between the radiating unit and a feeding point of the antenna, wherein the feeder is an impedance control line with increasing impedance, and configured to increase a working bandwidth of the antenna and to match the impedance of the radiating unit and the impedance of the feeding point.

3. The antenna according to claim 2, wherein the rear end of the feeding point is provided with a matching network, which is configured to adjust a resonance point of the radiating unit.

4. The antenna according to claim 3, wherein the antenna is provided on a Printer Circuit Board (PCB) to form a PCB antenna; and the PCB antenna is routed on a single-layer board or multi-layer board.

5. The antenna according to claim 3, wherein the antenna is applied to a Wireless Local Area Network (WLAN).

6. The antenna according to claim 2, wherein the feeding point is connected with a terminal through the impedance control line.

7. The antenna according to claim 6, wherein the impedance control line is one or some combination of the following: a straight line, an S shaped line, and a curved line; and the routing of the impedance control line is a microstrip line or a strip line.

8. The antenna according to claim 7, wherein the antenna is provided on a Printer Circuit Board (PCB) to form a PCB antenna; and the PCB antenna is routed on a single-layer board or multi-layer board.

9. The antenna according to claim 7, wherein the antenna is applied to a Wireless Local Area Network (WLAN).

10. The antenna according to claim 6, wherein the antenna is provided on a Printer Circuit Board (PCB) to form a PCB antenna; and the PCB antenna is routed on a single-layer board or multi-layer board.

11. The antenna according to claim 6, wherein the antenna is applied to a Wireless Local Area Network (WLAN).

12. The antenna according to claim 2, wherein the antenna is provided on a Printer Circuit Board (PCB) to form a PCB antenna; and the PCB antenna is routed on a single-layer board or multi-layer board.

13. The antenna according to claim 2, wherein the antenna is applied to a Wireless Local Area Network (WLAN).

14. The antenna according to claim 1, wherein the slot is hollowed out, or is filled with non-metal mediums.

15. The antenna according to claim 14, wherein the antenna is provided on a Printer Circuit Board (PCB) to form a PCB antenna; and the PCB antenna is routed on a single-layer board or multi-layer board.

16. The antenna according to claim 1, wherein the antenna is provided on a Printer Circuit Board (PCB) to form a PCB antenna; and the PCB antenna is routed on a single-layer board or multi-layer board.

17. The antenna according to claim 16, wherein the PCB antenna is provided on the same side of the terminal as the Wireless Fidelity (WIFI) or Bluetooth (BT), or provided on the top of the terminal.

18. The antenna according to claim 1, wherein the antenna is applied to a Wireless Local Area Network (WLAN).

* * * * *